United States Patent [19]

Damm

[11] Patent Number: 4,846,253

[45] Date of Patent: Jul. 11, 1989

[54] APPARATUS FOR COMPRESSING FOUNDRY MOULDING MATERIAL BY MEANS OF COMPRESSED GAS

[75] Inventor: Norbert Damm, Karlsdorf-Neuthard, Fed. Rep. of Germany

[73] Assignee: BMD Badische Maschinenfabrik Durlach GmbH, Karlsruhe, Fed. Rep. of Germany

[21] Appl. No.: 146,270

[22] Filed: Jan. 20, 1988

Related U.S. Application Data

[63] Continuation of Ser. No. 857,090, Apr. 29, 1986, abandoned.

[30] Foreign Application Priority Data

May 25, 1985 [DE] Fed. Rep. of Germany ..... 3518980

[51] Int. Cl.[4] ..... B22C 15/00

[52] U.S. Cl. ..... 164/169; 164/37

[58] Field of Search ..... 164/37, 38, 39, 40, 164/169, 200

[56] References Cited

U.S. PATENT DOCUMENTS 4,144,925 3/1979 Wernli ..... 164/169
4,572,274 2/1986 Zimmermann ..... 164/169

FOREIGN PATENT DOCUMENTS 3321622 12/1984 Fed. Rep. of Germany ..... 164/200
3321955 12/1984 Fed. Rep. of Germany ..... 164/200
425719 10/1974 U.S.S.R. ..... 164/169
521993 9/1976 U.S.S.R. ..... 164/169
793696 1/1981 U.S.S.R. ..... 164/169

*Primary Examiner*—Richard K. Seidel
*Attorney, Agent, or Firm*—Antonelli, Terry & Wands

[57] ABSTRACT

An apparatus for the compression of foundry moulding material by compressed gas, which comprises a pressure tank for the compressed gas forming an inlet pressure zone, a moulding zone positioned beneath the same constituted by a moulding box with filling frame and pattern plate with pattern, onto which the moulding material is loosely poured prior to compression, and a large-area valve arranged between the pressure tank and the moulding zone. The closure member thereof frees the valve opening in the pressure tank in a few milliseconds and moves into the inlet pressure zone. The closure member is driven by a pressure cylinder, whose piston on the lift side forms the moveable termination of a gas-pressurized pressure reservoir and by its opposite side is connected to a high pressure source. The high pressure-side outflow is constructed in such a way that the pressure medium flows out at a speed of more than 10 m/s, accompanied by the simultaneous acceleration of the piston, under the pressure in the pressure reservoir and the closure member into the raised open position.

22 Claims, 2 Drawing Sheets

APPARATUS FOR COMPRESSING FOUNDRY MOULDING MATERIAL BY MEANS OF COMPRESSED GAS

This is a continuation of application Ser. No. 857,090, filed Apr. 29, 1986 now abandoned.

BACKGROUND OF THE INVENTION

The present invention relates to an apparatus for compressing foundry moulding material by compressed gas, comprising a pressure tank for the compressed gas which constitutes an inlet pressure chamber, a moulding zone located beneath it constituted by a moulding box with filling frame and a pattern plate with pattern terminating the box at the bottom and onto which the moulding material is loosely poured prior to compression and a large-area value located between the pressure tank and the moulding zone, with the closure member of the valve being connected to a pressure cylinder as the drive, and the valve opening in the pressure tank being suddenly released, whereby the closure member moves into the inlet pressure chamber and can be brought into the closed position by the pressure cylinder.

In, for example, DE: P No. 32 43 951.2, U.S. Ser. No. 453,903 now U.S. Pat. No. 4,529,026, JP: No. 57-227 830, EP: No. 82 11 0996.4 a process and apparatus is described for compressing foundry moulding material, particularly moulding sand by compressed gas, such as, for example, compressed air or pressure gas produced by explosive combustion, with the compressed gas being relieved suddenly from a pressure tank into the moulding zone. The compressed gas acts on the free moulding material surface and compresses the moulding material particles accompanied by reciprocal momentum exchange, as well as by delaying the accelerated moulding material mass on the pattern top and pattern plate, with fluidization effects also occurring to reduce particle friction. It is important to have a high gas mass flow rate and an ultra-fast pressure rise in the moulding zone. The lower the initial pressure in the pressure tank, the higher must be these parameters, initial pressures being sought which are in the pressure range of operational compressed air networks, so that there is no need for excessive constructional expenditure for producing the compressed gas and for controlling the pressure. Thus, the apparatus must have a closure member, which closes a maximum cross-section for the flowing over of the compressed gas and has a minimum mass for freeing the cross-section as rapidly as possible. This calls for opening drives capable of bringing the closure member into the open position in a few milliseconds, so as to free the cross-section. The above requirements cannot be fulfilled with conventional valve constructions.

In, for example, DE: P No. 33 21 622.3, U.S. Ser. No. 617, 920 now U.S. Pat. No. 4,620,585, JP: No. 59-122 180, EP: No. 84 10 6795.2 the pressure gradient between the pressure tank and the moulding zone is utilized for opening the valve, in that the closure member is guided within the pressure tank and its opening movement is directed into the moulding zone. The closing drive for the closure member is constituted by a pressure cylinder, whose piston is connected to a guide rod of the closure member. The guide rod is fixed by a clamping device in the closed position.

At least during the opening movement, the pressure cylinder is disengaged from the guide rod so as not to have to work against the pressure in the pressure cylinder. The driving connection is then restored and the closure member is again brought into the closed position by the guide rod.

All the above constructions suffer from the disadvantage that the large-area closure member opens into the moulding zone, so that corresponding to the height of lift and the geometrical dimension of the closure member provided in the lifting direction requires the provision of a free space above the moulding material surface, represents of dead space that must be filled with the compressing gas during the compressing process. This reduces the pressure gradient (time rise of the pressure in the moulding zone), which is decisive for the result of the compression and unnecessary gas masses have to be accelerated. In addition, the compressed gas consumption is correspondingly high.

SUMMARY OF THE INVENTION

Thus, the invention is based on a known apparatus, in which the closure member opens into the inlet pressure chamber and is moved by a pressure cylinder out of the closed position into the open position and vice-versa, so that a dead space within the moulding zone is avoided. However, in known apparatus of this type it is not possible to carry out the opening movement of the closure member fast enough counter to the gas pressure, for example, in a few milliseconds, so that, in the case of such apparatus pressures in the inlet pressure chamber of 20 bar and more have been proposed which, as stated, lead to an unacceptably high constructional expenditure.

Thus, the aim of the present invention is to further develop the aforementioned apparatus so that a high opening speed for the closure member is achieved, accompanied by reduced constructional expenditure and a gas pressure in a range of the network pressure of conventional compressed air networks.

According to the invention, the piston of the pressure cylinder forms, on the lifting side therefore, the movable termination of a pressure reservoir subject to the action of the gas and is connected by an opposite side thereof to a hydraulic high pressure source, with the high pressure-side outflow being constructed in such a way that the pressure medium flows out at a speed of $>10$ m/s, accompanied by the simultaneous acceleration of the piston under the pressure in the pressure reservoir and the closure member into the raised open position.

The function of the apparatus according to the invention is as follows. The closing of the closure member takes place counter to the at least partly relieved pressure reservoir under the action of the pressure from the hydraulic high pressure source. For opening the closure member, the pressure reservoir is brought to the operating pressure, while the high pressure circuit on the opposite side of the piston is simultaneously cut off. The high pressure side is then opened, so that the hydraulic fluid flows out of the pressure cylinder at a speed higher than 10 m/s and the piston suddenly raises the closure member under the highly pressurized gas pressure, so that within a few milliseconds it opens counter to the operating pressure in the pressure tank.

Practical test with the know apparatus have shown that, for moulding boxes of medium size, the pressure build-up must take place over the moulding material surface with a pressure gradient of approximately 200 to 300 bar/s, in order to achieve a completely satisfactory compression. This leads to a closure member speed above 1/s in the case of a large-area closure member, with optimize low mass and an initial pressure like that prevailing in plant-internal compressed pressure like that prevailing in plant-internal compressed air networks. If, as is to be provided by the invention, the opening movement is to be brought about by the pressure cylinder, which is also used for closing the closure member, then in the case of a predetermined pressure in the pressure reservoir, this presupposes high outflow rates for the pressure medium volume displaced by the piston during the opening movement. According to the invention this outflow rate must be >10 m/s that is, in a range which is higher by a factor of ten than the speeds normally prevailing in hydraulics. This much higher outflow speed for the displacement volume can be achieved through corresponding constructional measures. The actual piston speed can only achieve values around 5 m/sec.

According to the invention, on the high pressure side, the pressure cylinder has a small displacement volume of, for example, e.g. 150 to 500 $cm^3$. The smaller the displacement volume, the shorter the outflow time or lift time for given cross-sections.

According to further features of the invention, the high pressure-side outflow is disengaged from the remaining high pressure circuit and is connected by a relatively large cross-section line to a drain tank.

By virtue of the above noted features, the flow resistance for the outflowing displacement volume is kept as small as possible, and the disengagement from the remainder of the high pressure circuit means that the pressure medium quantity to be displaced is small. The drain tank provides the possibility of obtaining a rapid pressure drop on the outflow side.

A pressure between 100 bar and 300 bar has proved appropriate for the high pressure source and such reassures can easily be obtained in hydraulics.

The pressure reservoir, whose pressure acts on the lift side of the piston, in the closed position of the closure member, that is, when the piston is in the raised end position, is under a gas pressure between 20 bar and 50 bar, which directly or indirectly, for example, via a hydraulic cushion acts on the piston. As form approximately 50 bar, the effect of a gas pressure cushion, which is, in principle, already present at lower pressures, act very advantageously in the sense of an additional acceleration. The final pressure is again between 100 and 300 bar.

It has also proved advantageous if the ratio of the pressure reservoir volume and the displacement volume of the pressure cylinder is at least 5:1 and is preferably 10:1 to 15:1.

According to still further features of the invention the pressure reservoir comprises a gas-filled cylinder terminated by a movable piston, which, on the side opposite to the gas pressure side is connected to a hydraulic high pressure source, by which the gas pressure reservoir is connected to that for the opening pressure source by which the reservoir can be brought to the final pressure necessary for the opening movement.

The apparatus according to the invention is also characterized by a restrictor or throttle acting towards the end of the lift movement of the pressure cylinder piston and which ensures that the piston and, consequently, the closure member can be decelerated over a short distance.

In preferred manner, the high pressure source is connected via a control slide valve, a check valve and a ring main to the pressure cylinder and the ring main is connected to the drain tank via a controllable check valve. As stated, the ring main has a maximum cross-section, in order to permit a rapid outflow of the pressure medium.

Finally, according to the present invention, the control slide valve, in a first position, connects the pressure cylinder to the high pressure source and opens the control line of the controllable check valve, so that the latter closes and, in a second position, connects the controlling to the high pressure source, so that the check valve opens counter to the pressure in the branch line and connects the pressure cylinder to the drain tank.

It is also possible according to the present invention for the pressure reservoir to be connected via a control slide valve to the hydraulic high pressure source and, in a first position, the control slide valve connects the pressure reservoir to the hydraulic source, so that the gas in the pressure reservoir and on the lift side in the pressure cylinder is compressed to the final pressure, while simultaneously there is high pressure on the opposite side of the pressure cylinder piston, while in a second position providing a connection to a drain tank.

BRIEF DESCRIPTION OF THE DRAWINGS

The invention is described in greater detail hereinafter relative to non-limitative embodiments and the attached drawings, wherein.

DETAILED OF THE PREFERRED EMBODIMENTS

Figure 1:
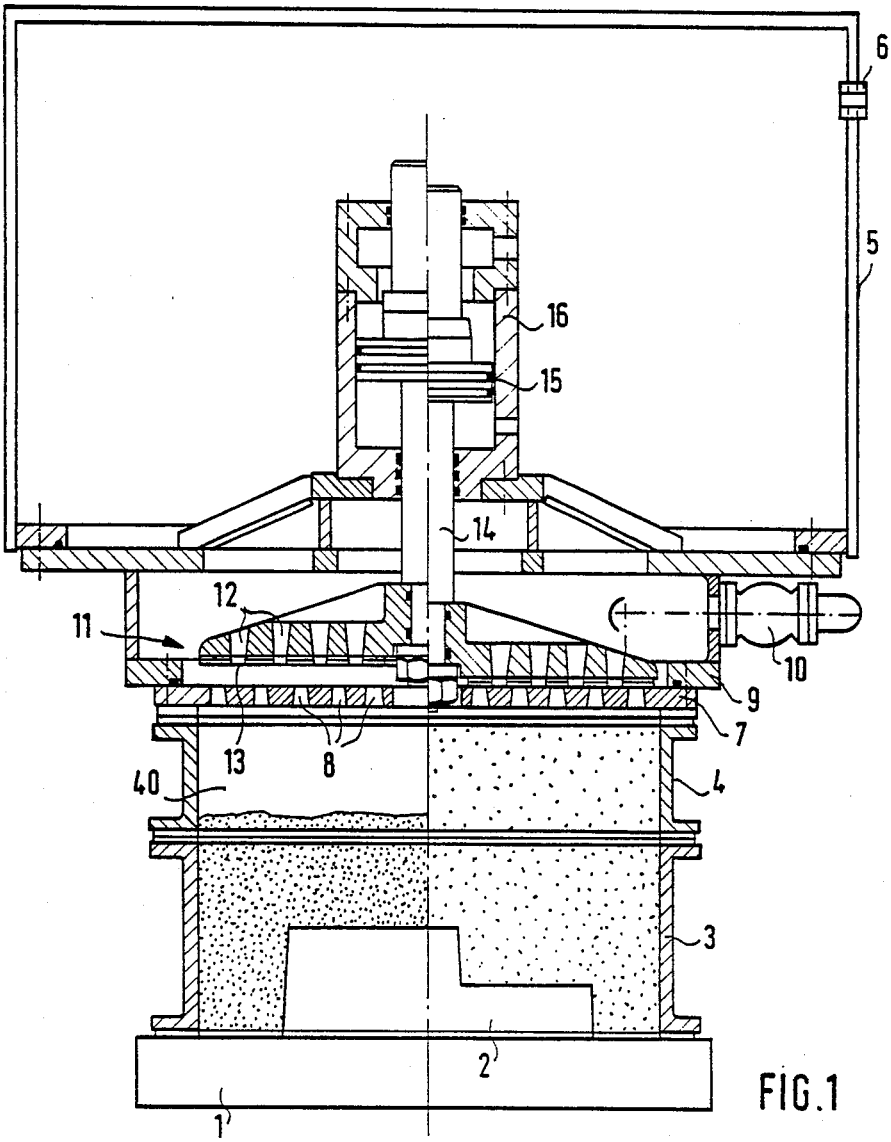
FIG. 1, a section through an embodiment of the apparatus, and FIG. 2, an embodiment of the pressure cylinder control system.

The drawings only show those parts of the compression apparatus of a foundry moulding machine necessary for the understanding of the invention. No reference is made in the drawing to the machine column, the device for raising and lowering the moulding box and filling frame, as well as optionally for ejecting the finished mould from the moulding box. In addition, no reference is made to the devices for introducing the pattern and for moulding sand filling, because these components are well known in foundry machine construction.

As shown in FIG. 1, a moulding box 3 is located on a pattern plate 1 with a pattern 2 and on the moulding box 3 is located in filling frame 4. A pressure tank 5, is provided above the moulding zone, which in the illustrated embodiment of FIG. 1 serves to receive compressed air and which is applied via a connection 6 from a pressure reservoir or, in the case of low inlet pressure, from an operational compressed air network.

The bottom 7 of the pressure tank 5 includes a plate, which is provided in grate-like manner with a plurality of openings 8 above the moulding zone. A frame 9 is flanged at a top of the bottom 7 line with a valve 10. Pressure tank 5 with the frame 9 and the pattern plate 1 with the pattern 2, the moulding box 3 and the filling frame 4 are movable with respect to one another, so as to be able to be filled with moulding material in the moulding zone up to just below the bottom 7. Prior to compression, these two subassemblies are brought together and sealingly compressed at their joint face.

A closure member is the form of a rigid valve plate generally designated by the reference numeral 11 cooperates with the bottom 7 of its area having the openings 8 is also provided with a plurality of openings 12. A sealing covering 13 is also provided on the underside of the valve plate within the area of openings 12. The openings 8 in bottom 7 and the openings 12 in valve plate 11 are so displaced with respect to one another that they do not coincide in the closed position.

Valve plate 11 is located on a guide rod 14, which simultaneously forms the piston rod of piston 15 of a pressure cylinder 16.

Figure 2:
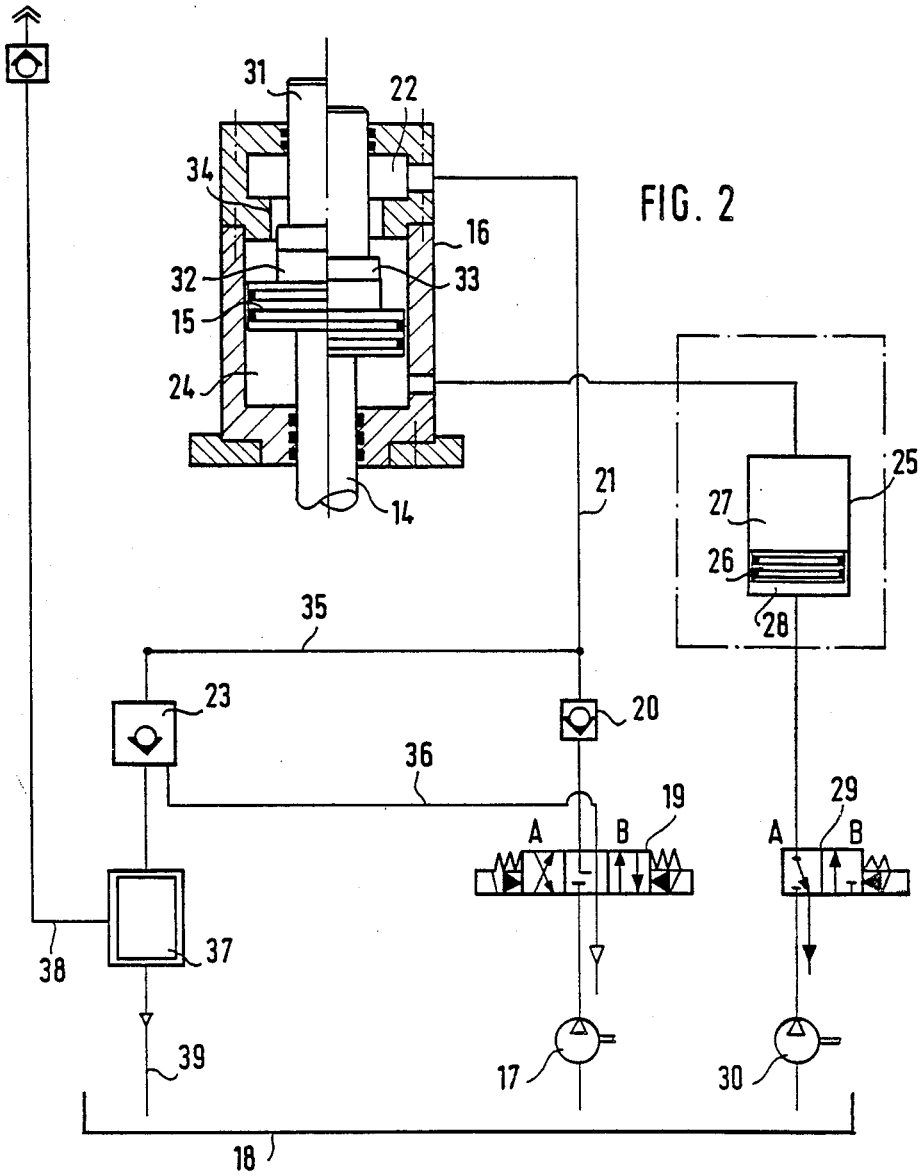

As shown in FIG. 2, the pressure cylinder 16 is arranged in a hydraulic circuit including a pressure source 17. Such as, for example, a hydraulic pump, which is supplied with hydraulic fluid from a tank 18. From pressure source 17, the pressure passes via a control slide valve 19 and a check valve 20 into a feed line 21, issuing both into the pressure zone 22 of pressure cylinder 16 and leading to a controllable check valve 23.

Below the piston 15, the pressure cylinder 16 has a gas pressure zone 24, connected to the gas pressure reservoir 25 which is subdivided by a movable piston 26 into a gas pressure zone 27 and a hydraulic pressure zone 28 with the hydraulic pressure zone 28 being connected via a control slide valve 29 to a high pressure source 30 supplied from the supply tank 18.

On the hydraulic side, the piston 15 of the pressure cylinder 16 is extended by a piston rod 31 passing through the pressure zone 22. The upper piston rod 31 carries directly on the extension of piston 15 a cylindrical shoulder 32 and a conically tapered shoulder 33, which, during the upward lift movement of piston 15, forms a throttle or restrictor with the cylindrical constriction 34.

Hydraulic line 21 is connected to a branch line 35, leading to the controllable check valve 23, whose control line 36 can be connected via the control slide valve 19 to pressure source 17. The pressure zone in the open operating state of check valve 23 is connected, in a pressure-relieved manner, via lines 21 and 35 to a drain tank 37 and a vent line 38. Drain line 39 of drain tank 37 issues into hydraulic tank 18.

In order to bring the valve plate 11 out of the position shown to the left in FIG. 1 into the closed position shown in right-hand half of FIG. 1, the control slide valve 19 is brought into operating position B. In the operating position B, the connection is formed between pressure source 17 and the operating zone 22 of the pressure cylinder 16, accompanied by the opening of check valve 20. At the same time the control line 236 of the controllable check valve 23 is operated in pressureless manner, so that the check valve 23 closes. Thus, the pressure medium fills the operating zone 22 and the plate 11 until the valve plate 11 reaches the closed position illustrated in the right hand half of the FIG. 1, accompanied by the pretensioning of the seal 13. At this time the control slide valve 29 is in operating position A. The gas pressure zone 24 of pressure cylinder 16 with an open connection to the gas pressure reservoir 25 receives a low pressure prefilling of, for example, 30 bar to 40 bar. The volume ratio of the gas pressure zones 24, 27 is approximately 1:10 to 1:15. The gas pressure prefilling in the gas pressure zone 24, 27 is slightly compressed with the closing lift movement of valve plate 11, the pattern plate 1 is braced with the filled moulding box 3 and the filling frame 4 with the frame 9. The gas pressure tank 5 is filled to operating pressure via the pressure connection 6.

Valve 10 is in the closed position. After bracing the moulding means with the frame 9, the control slide valve 29 is brought into the operating position B. The pressure zone 28 of the gas pressure reservoir 25 is therefore linked with the high pressure source 30. The gas pressure zones 27, 24 are compressed to an operating pressure of approximately 200 to 250 bar, at this time, the valve plate 11 is in the highly pretensioned, but still blocked state on the side of pressure zone 20.

Valve plate 11 must be brought into the open position illustrated in the left-hand half of FIG. 1 for the sudden relief of the pressure tank 5 and for compressing the moulding material in the moulding box 3 and filling frame 9 and, for this purpose, the control slide valve 19 is brought into the position A. The pressure of the pressure source 17 then prevails in the control line 36, so that the check valve 23 opens. Via the relatively large drain cross-sections of the lines 21, 35, the pressure medium flows out of the operating zone 22, under the action of the pressure reservoir 24, via the check valve 23 into the drain tank 37. Towards the end of lowering movement of the piston 15, the drain cross-section between the rod 32 and the constriction 34 is reduced by the conical portion 33 on the piston rod 31, so that the piston and, consequently, the valve plate 11 are decelerated. During the opening movement, the pressure medium to be displaced from the operating zone 22 flows out at a speed of more than 10 m/s and, preferable, between 20 m/s and 30 m/s. Between the operating strokes, drain tank 37 can be vented by the line 38, so that its contents can flow out into the system tank 18.

Following the compression of the moulding material the valve plate 11 is initially brought into the closed position, as hereinbefore. The pressure zone 40 formed beneath the fixed base plate 7 is vented by the valve 10. After separating the pattern and the compressed mould, a new operating cycle commences.

What is claimed is:

1. An apparatus for compressing foundry moulding material by compressed gas, the apparatus comprising: a pressure tank for the compressed gas including an inlet pressure chamber;

a moulding zone located beneath the inlet pressure chamber including a moulding box with a filling frame and a pattern plate with a pattern terminating the moulding box at a bottom thereof and onto which the moulding material is loosely poured prior to a compression;

a large-area valve located between the pressure tank and the moulding zone, said large area valve including at least one valve opening and a valve closure member cooperable with at least one valve opening to open and close the same;

means for moving the closure member into a closed position covering at least one valve opening and an open position uncovering the at least one valve opening including a driving pressure piston disposed in a pressure cylinder and connected to said valve closure member;

a pressure reservoir subject to an action of gas, formed on a lifting side of the pressure piston;

a hydraulic high pressure source connected to the pressure piston on an opposite side from said pressure reservoir;

means for enabling a high pressure-side outflow so as to cause a pressure medium to flow out at a speed of $>10$ m/s, with a simultaneous acceleration of the pressure piston;

means to accelerate the pressure piston simultaneously with said high pressure-side outflow by pressure in the pressure reservoir to raise the closure member into the inlet pressure chamber to the open position.

2. An apparatus according to claim 1, wherein the pressure cylinder is provided on high pressure side with a small displacement volume, of between 150–500 cc.

3. An apparatus according to one of claims 1 or 2, wherein control members are provided for shutting off the high pressure-side out flow from a remaining high pressure circuit, and wherein the high pressure outflow is connected by a large cross-section line to a drain tank.

4. An apparatus according to claim 3, wherein the pressure of the high pressure source is between 100 and 300 bar.

5. An apparatus according to claim 4, wherein the pressure reservoir in the closed position of the closure member is under an inlet pressure of between 20 and 50 bar.

6. An apparatus according to claim 5, wherein a ratio of a volume of the pressure reservoir to a displacement volume of the pressure cylinder is in a range of at least 5:1.

7. An apparatus according to claim 5, wherein a ratio of a volume of the pressure reservoir to a displacement volume of the pressure cylinder is in a range of from 10:1 to 15:1.

8. An apparatus according to claim 6, wherein the pressure reservoir comprises a gas-filled cylinder terminated by a movable piston connected on a source opposite to the gas pressure side to said hydraulic high pressure side.

9. An apparatus according to claim 8, wherein at least one of a throttle and restrictor acting towards the end of the lift movement of the pressure piston is provided.

10. An apparatus according to claim 9, wherein the piston has a piston rod extending into a high pressure-side cylinder zone and has a conical thickened portion cooperating with a constriction in said cylinder zone.

11. An apparatus according to claim 1, wherein a control slide valve, a check valve, and a ring main are provided for connecting the high pressure source to the pressure cylinder, and wherein a controllable check valve connects the ring main to a drain tank.

12. An apparatus according to claim 11, wherein the control slide valve connects the pressure cylinder to the high pressure source in a first position and pressure-relieves a control line of the controllable check valve, so that the latter closes, while in a second position the control slide valve connects the control line to the high pressure source, so that the check valve opens counter to the pressure in the ring main and connects the pressure cylinder to the drain tank.

13. An apparatus according to claim 1, wherein a control slide valve connects the pressure reservoir to the hydraulic high pressure source, and wherein, in a first position, the control slide valve connects the pressure reservoir to the high pressure source, so that the gas in the pressure reservoir and on the lift side in the pressure cylinder is compressed to the final pressure, while high pressure simultaneously prevails on the opposite side of the pressure piston and, in a second position, provides a connection with a drain tank.

14. An apparatus according to claim 1, wherein the pressure of the high pressure source is between 100 and 300 bar.

15. An apparatus according to claim 1, wherein the pressure reservoir in the closed position of the closure member is under an inlet pressure of between 20 and 50 bar.

16. An apparatus according to claim 1, wherein a ratio of a volume of the pressure reservoir to a displacement volume of the pressure piston is at least 5:1.

17. An apparatus according to claim 16, wherein a ratio of a volume of the pressure reservoir to the displacement volume of the pressure piston is 10:1–15:1.

18. An apparatus according to claim 1, wherein the pressure reservoir comprises a gas-filled cylinder terminated by a movable piston connected on a side opposite to the gas pressure side to said hydraulic high pressure source.

19. An apparatus according to claim 1, wherein at least one of a throttle and restrictor acting towards the end of the lift movement of the pressure piston is provided.

20. An apparatus according to claim 14, wherein the piston has a piston rod extending into a high pressure-side cylinder zone and has a conical thickened portion cooperating with a constriction in said cylinder zone.

21. An apparatus according to claim 1, wherein the means for enabling a high pressure-side outflow includes a first drain line connecting the high pressure-side of the pressure reservoir to a drain tank and a second drain line connecting the drain tank to a hydraulic tank.

22. An apparatus according to claim 21, wherein the drain tank includes a vent line.

* * * * *